US007221098B2

(12) United States Patent
Gräf et al.

(10) Patent No.: US 7,221,098 B2
(45) Date of Patent: May 22, 2007

(54) ELECTRIC LAMP WITH OUTER BULB AND ASSOCIATED SUPPORT BODY

(75) Inventors: Jürgen Gräf, Augsburg (DE); Andreas Hohlfeld, Berlin (DE); Michael Hülsemann, Schönwalde (DE); Anton Schlögl, Biberbach (DE); Karen Twesten, Berlin (DE)

(73) Assignee: Patent-Treuhand-Gesellschaft für elektrische Glülampen mbH, Munich (DE)

( * ) Notice: Subject to any disclaimer, the term of this patent is extended or adjusted under 35 U.S.C. 154(b) by 210 days.

(21) Appl. No.: 10/858,375

(22) Filed: Jun. 2, 2004

(65) Prior Publication Data

US 2004/0256986 A1 Dec. 23, 2004

(30) Foreign Application Priority Data

Jun. 5, 2003 (DE) ..... 103 25 552

(51) Int. Cl.
*H01J 17/16* (2006.01)
*H01J 61/30* (2006.01)

(52) U.S. Cl. ..... 313/634; 313/553; 313/559; 313/623

(58) Field of Classification Search ..... 313/634, 313/292, 553, 557, 559, 562, 623
See application file for complete search history.

(56) References Cited

U.S. PATENT DOCUMENTS 4,499,396 A * 2/1985 Fohl et al. ..... 313/25
4,709,184 A * 11/1987 Keeffe et al. ..... 313/638
4,859,899 A * 8/1989 Keeffe et al. ..... 313/25
5,075,586 A * 12/1991 Jaeger et al. ..... 313/25
5,128,589 A 7/1992 Dakin ..... 313/634
5,327,042 A 7/1994 Bazin et al. ..... 313/25
5,493,167 A * 2/1996 Mikol et al. ..... 313/25
5,594,294 A * 1/1997 Duffy et al. ..... 313/25
5,719,463 A * 2/1998 Hassink et al. ..... 313/25
5,731,662 A * 3/1998 Parrott et al. ..... 313/549
5,825,127 A 10/1998 Weinhardt ..... 313/553
6,043,603 A 3/2000 Weinhardt ..... 313/566
6,157,131 A * 12/2000 Nelson et al. ..... 313/634
6,629,768 B2 * 10/2003 Melson et al. ..... 362/311

(Continued)

FOREIGN PATENT DOCUMENTS

CA 2042143 12/1991

(Continued)

OTHER PUBLICATIONS

A. Dobrusskin et al., "Halogen-Metalldampflampen kleiner Leistung mit niedrigen Farbtemperaturen", Technisch-wissenschaftliche Abhandlungen der Osram-Gesellschaft, vol. 12, Springer-Verlag, Berlin 1986, pp. 11 to 14.

*Primary Examiner*—Mariceli Santiago
*Assistant Examiner*—Kevin Quarterman
(74) *Attorney, Agent, or Firm*—William E. Meyer

(57) ABSTRACT

The lamp comprises a discharge vessel (2) which is closed off in a vacuum-tight manner and is arranged in an outer bulb (12), a getter material being held on a support body inside the outer bulb (12). The support body is a support strip (31) to which the getter material is applied, the support strip being bent in such a way that it is automatically held in the outer bulb (12) without the need for any auxiliary means.

8 Claims, 6 Drawing Sheets

U.S. PATENT DOCUMENTS

| | | | | |
|---|---|---|---|---|
| 6,741,013 | B2 * | 5/2004 | Dakin et al. | 313/25 |
| 6,958,575 | B2 * | 10/2005 | Dombrowski et al. | 313/489 |
| 2002/0063529 | A1 | 5/2002 | Fukai et al. | 313/623 |
| 2002/0067115 | A1 | 6/2002 | Nagata et al. | 313/318.02 |

FOREIGN PATENT DOCUMENTS

| | | |
|---|---|---|
| CA | 1310058 | 11/1992 |
| DE | 195 21 972 | 12/1996 |
| DE | 196 27 731 | 1/1998 |
| DE | 101 59 379 | 6/2002 |
| DE | 101 57 868 | 7/2002 |
| EP | 0 465 083 | 1/1992 |
| EP | 0 481 702 | 4/1992 |

* cited by examiner

ELECTRIC LAMP WITH OUTER BULB AND ASSOCIATED SUPPORT BODY

TECHNICAL FIELD

Reference is made to application with docket no. 2003P08148DE filed in parallel, which provides a more detailed description of processes for producing a lamp with a getter strip.

The invention relates to an electric lamp with outer bulb and with an inner vessel, in particular a discharge vessel, arranged therein, a getter material being held on a support body inside the outer bulb. It deals in particular with discharge lamps, such as metal halide lamps, but also with incandescent halogen lamps.

BACKGROUND ART

U.S. Pat. No. 5,825,127 has disclosed a process for producing a cap strip for discharge lamps, in which the cap strip is a support strip comprising a material which is to be introduced into the lamp, in particular mercury and/or getter material as a coating. The only application area envisaged for cap strips of this type in that document is as the discharge vessel of a low-pressure mercury lamp. In this case, the cap strip is often secured in the vicinity of an electrode, cf. in this respect also U.S. Pat. No. 6,043,603. A support strip with getter is also referred to as a getter strip.

An example of an incandescent halogen lamp with a getter in the outer bulb is to be found in CA-A 1,310,058.

Getters are usually used on a disk as a base in the outer bulbs of high-pressure discharge lamps in order to absorb impurities. For example, U.S. Pat. No. 5,327,042 uses a Zr getter on an iron sheet base which is securely welded to the frame. In the case of discharge vessels which are closed on two sides in an outer bulb which is closed on two sides, getters are usually secured in the pinch of the outer bulb using a piece of wire or at the outer supply conductor or at a sheet-metal shell placed around the pinch of the discharge vessel, cf. in this respect Technisch wissenschaftliche Abhandlungen der OSRAM-Gesellschaft, Vol. 12, Springer-Verlag, Berlin 1986, pp. 11 to 14.

DISCLOSURE OF THE INVENTION

It is an object of the present invention to provide an electric lamp with outer bulb and with an inner vessel, in particular a discharge vessel, arranged therein, a getter material being held on a support body inside the outer bulb which lamp allows simple, inexpensive and space-saving securing of a getter in the outer bulb. A further object is to provide a support body which is particularly well adapted and in particular is especially suited for this purpose.

This object is achieved by the feature that the support body is a support strip to which the getter material is applied, the support strip being curved in such a way that it is automatically held in the outer bulb without the need for any auxiliary means. Particularly advantageous configurations are to be found in the dependent claims.

The electric lamp according to the invention has an outer bulb and an inner vessel which is arranged therein and is closed off in a vacuum-tight manner, generally a discharge vessel. It is usually held in the outer bulb by means of a frame. However, the lamp may also be an incandescent halogen lamp with an outer bulb. A getter material is held on a support body in the outer bulb, the support body being a support strip to which the getter material is applied as a layer, as is known per se from U.S. Pat. No. 5,825,127. According to the invention, however, the support strip itself is used directly as a holding mechanism, with the support strip being bent in such a way that it is automatically held in the outer bulb without the need for any auxiliary means.

The invention may be realized in various ways; in one embodiment, the support strip consists of flexible material. In this case, a simple holding mechanism can be produced by the discharge vessel having at least one pinch, with the support strip being wrapped around at least part of the pinch. If the inner vessel, which is generally a discharge vessel, has at least one fused seal, the support strip is wrapped around at least part of the fused seal.

In a second embodiment, the support strip consists of elastic, resilient material, in particular of spring steel. With this condition, it is possible for the support strip to be held on the inner surface of the outer bulb by spring forces alone.

Reliable holding is achieved if the support strip is clamped into notches in the inner surface of the outer bulb.

One alternative is for the support strip to be bent in such a way that it has at least three bearing points against the inner surface of the outer bulb.

A further embodiment requires the support strip to be perforated and to be secured to the discharge vessel in a clamping fashion by bending at the perforated locations. In this case, of course, the support strip may additionally be resilient or at least flexible.

Particularly secure holding of the support strip in the outer bulb is achieved by virtue of the outer bulb being provided with a bulge which assists with secure holding of the support strip.

A particularly preferred embodiment, in which the advantages of the novel concept manifest themselves particularly clearly, is an arrangement in which the discharge vessel is closed off by sealing parts at opposite ends, with the outer bulb only partially surrounding the discharge vessel and ending in the region of the sealing parts at the latest.

One typical application is metal halide lamps and incandescent halogen lamps.

BRIEF DESCRIPTION OF THE DRAWINGS

The invention is to be explained in more detail below with reference to a plurality of exemplary embodiments, in which.

BEST MODE FOR CARRYING OUT THE INVENTION

Figure 1:
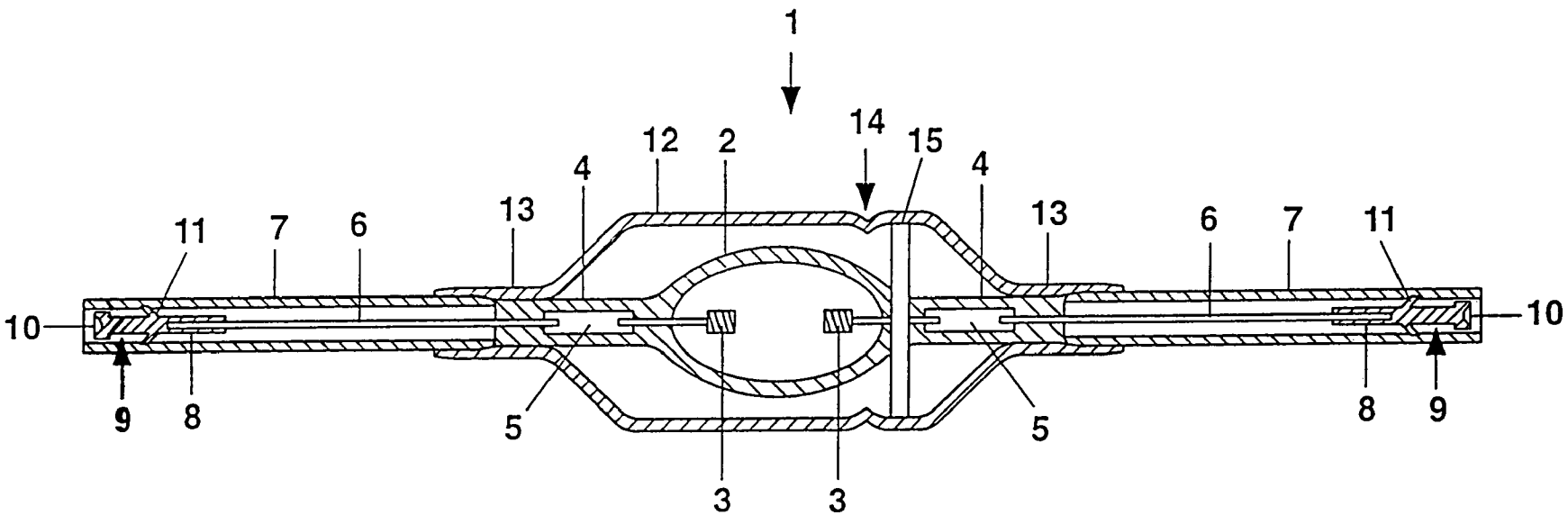
FIG. 1 shows a side view, in section, of a metal halide lamp.

FIG. 1 shows a side view of a metal halide lamp 1 which is pinched on two sides. The discharge vessel 2, which is designed as a barrel-like body made from quartz glass, encloses two electrodes 3 as well as a metal halide fill. The bulb ends are sealed by pinches 4 in which foils 5 are embedded. The foils are connected to external supply conductors 6. The external supply conductor 6 is guided inside a tubular sleeve 7 and ends in a bush 8 of an integral cap part 9. The cap is produced as a single part from steel and also comprises a circular disk 10 as contact element and barb 11 as centering and holding means. The part of the discharge vessel which bulges out is surrounded by an outer bulb 12 which is rolled on (13) in the region of the transition between the pinch 4 and the sleeve 7. The outer bulb 12 has an encircling indentation 14, so that an elastic support strip 15 made from iron, in particular nickel-plated, or steel is spread apart against the inner surface of the outer bulb without being able to slip laterally. The support strip contains getter materials, such as Zr, Fe, V, Co, which are used to absorb various substances, such as oxygen, hydrogen or the like. The outer bulb may be filled with nitrogen, another inert gas or vacuum.

One possible form of production is described, for example, in US 2002/063 529, US 2002/067 115 or U.S. Pat. No. 5,128,589. A variant with a complete outer bulb is indicated, for example, in CA 2 042 143. The concept of the invention can be used for all these designs.

A further production method is described below with reference to FIG. 2*a*: first of all, the discharge vessel 2 is completed from a cylindrical tube by means of a forming roll and if appropriate pinching jaws, which in each case fix an electrode system which has been introduced into the still-open tube, for example by pinching, until the stage at which it has been provided with a seal (pinch 4 or fuse seal) at both ends. At the same time, integrally attached, sleeve-like extension parts 7 remain in place at the seals. While a first extension part 7*a* is being closed up by the end 16*a*, which is initially still open, of the extension part being dropped onto a cap part 17 which has been introduced, a pumping hole 18 remains open at the second extension part 7*b*. Moreover, the open end 16*b* is not initially treated. In parallel, the cylindrical outer bulb 12 is pretreated until an encircling indentation 14 laterally fixes a support strip clamped next to it in the outer bulb 12. The ends of the outer bulb are then rolled onto the extension part 7 on both sides by means of prior heating by flames (arrow P1), specifically in such a way that the fixing at the end 16*b* of the second extension part 7*b* takes place outside the still-open pumping hole 18. At the height of the pumping hole 18, although the outer bulb 12 is rolled in down to a fraction of its original diameter, it is not yet rolled in to such an extent that it bears against the extension part 7*b* (arrow P2). At the still-open end 16*b* of the second extension part 7*b*, this arrangement is connected via a feedline 38 to a pumping and filling system 39, in particular by a pumping rubber 40 being fitted to the end of the extension part. The atmosphere in the outer bulb can then be evacuated. The pumping path is indicated as arrow P3. Then, the outer bulb 12 can be supplied with a substantially inert atmosphere via this pumping path or a vacuum can be maintained. In the next step, the pumping hole 18 is closed up, either by being closed by rolling, being melted shut by means of a laser, or simply by material automatically dropping onto it after heating under the application of reduced pressure. Then, the end 16*b* of the second extension part is also "shrunk on". The getter strip 15 may, if necessary for the getter used, subsequently be activated through the outer bulb 12 by means of a laser.

Figures 2A, 2B:
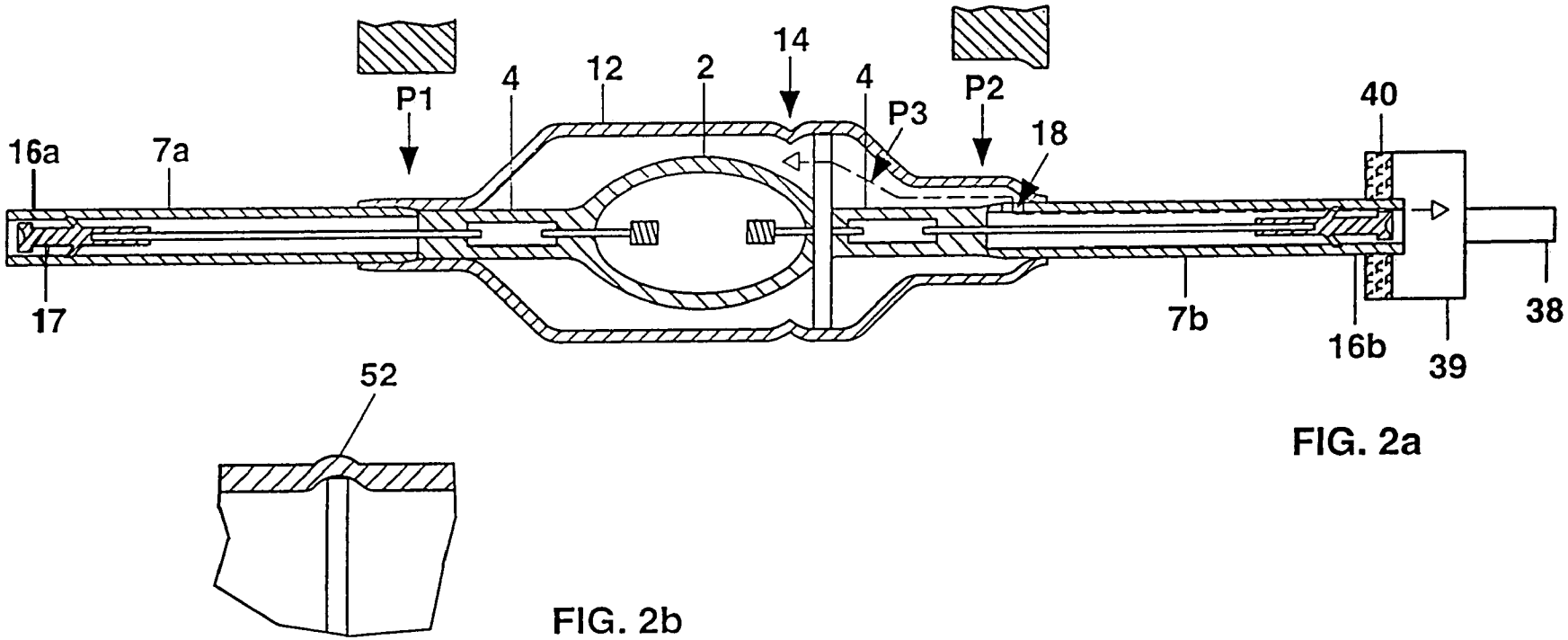
FIG. 2 shows a production process, in highly diagrammatic form, for the lamp shown in FIG. 1.

Instead of an indentation 15 as an inwardly facing bulge as the lateral boundary, it is also possible to use an outwardly facing bulge (52) in which the support strip is guided on account of the two-part lateral delimitation, cf. FIG. 2*b*.

Figure 3:
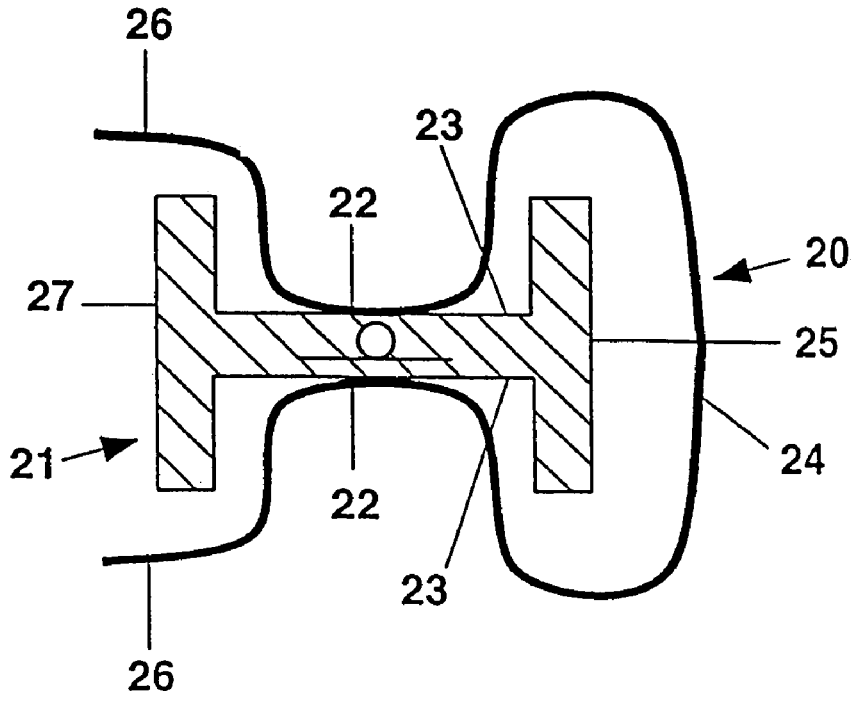
FIG. 3 shows a metal halide lamp in cross section with support strip.

FIG. 3 shows the principle of a further way of securing the support strip. In this case, the support strip 20 is secured directly to the H-shaped pinch 21 (shown in cross section) by being bent in such a way that two contact sections 22 thereof touch the two wide sides 23 of the pinch 21 in a clamping manner, whereas a central section 24, located between them, of the support strip surrounds a first narrow side 25 at a distance therefrom. The free ends 26 of the support strip protrude towards the second narrow side 27 at the pinch.

Figure 4:
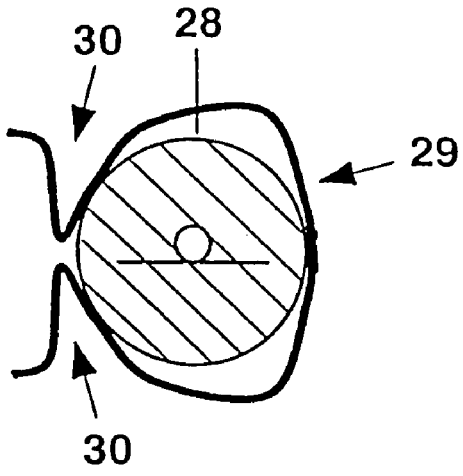
FIGS. 4 to 9 show further exemplary embodiments for lamps with support strip in cross section.

A similar concept can also be used for a lamp with a fused seal 28. FIG. 4 shows a cylindrical fused seal 28 in section. The support strip 29 with getter surrounds the fused seal 28 virtually completely, specifically it surrounds at least three quarters of its circumference, bearing against it at at least three points. The free ends 30 of the support strip are bent back through approximately 330° and are also angled off through approximately 90° at the direct end, with these free end pieces acting as a fitting aid.

Figure 5:
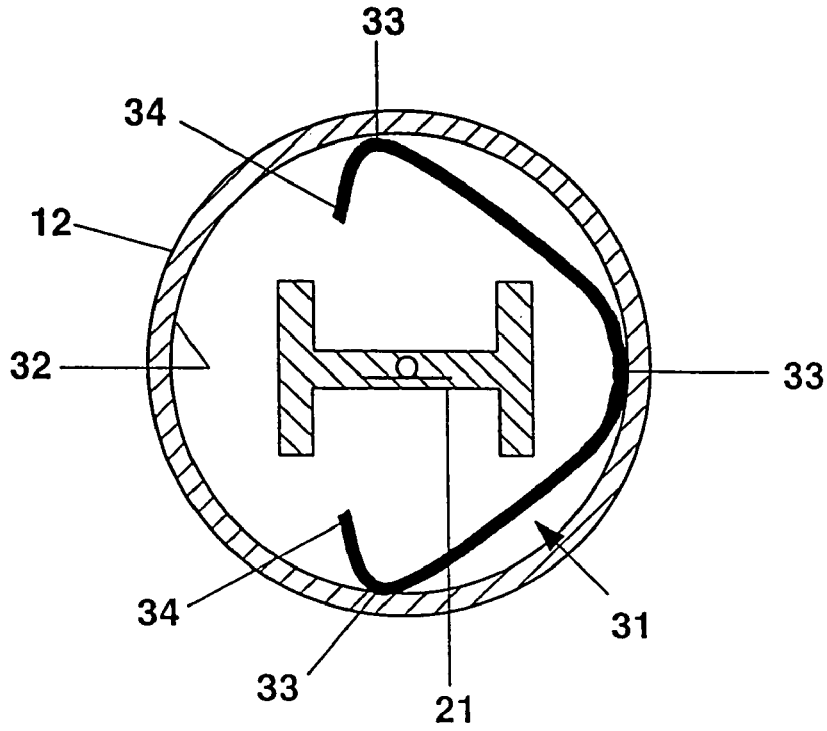

Another concept is shown in FIG. 5. In this case, the support strip 31 is not secured to the pinch 21 (or fused seal), but rather to the inner surface 32 of the outer bulb, by virtue of the support strip being formed from spring steel or nickel-plated iron approximately as an isosceles triangle with rounded corners 33 and an open base 34. The rounded corners form the three contact points with respect to the outer bulb. To be held securely, it is advantageous if the three contact points span slightly more than half the circumference of the outer bulb, in particular approximately 55 to 75%. The temperature to which the support strip is exposed, on account of its proximity to the discharge vessel, is in this case relatively high, and consequently this configuration is eminently suitable for getter materials which require a high temperature in order to be effective. This concept is also eminently suitable for fused seals, since fused seals take up less space than pinches.

Figure 6:
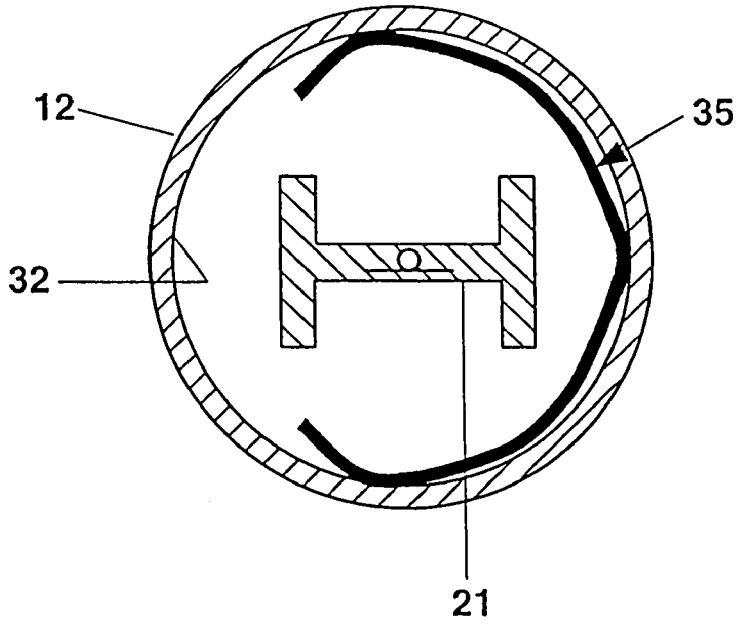

A second variant shown in FIG. 6 is designed for getters which require a relatively low temperature to provide an optimum efficiency. In this case, the support strip 35 is nestled significantly more closely to the inner surface 32 of the outer bulb. For this purpose, the support strip 35 is bent approximately in a C shape, so that it acquires a further distance from the pinch 21 of the discharge vessel.

Figure 7:
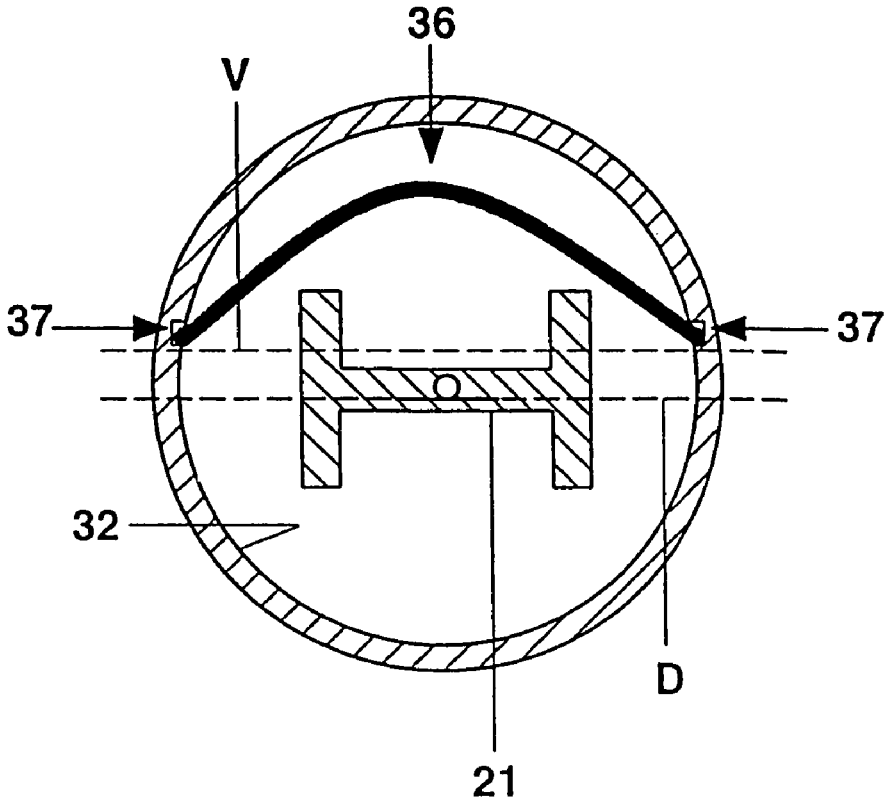

FIG. 7 shows a further embodiment. In this case, the support strip 36 is clamped between two slots 37 at the inner surface 32 of the outer bulb, so that it is curved in a roof shape. The two slots 37 are arranged slightly eccentrically with respect to an imaginary parallel diameter D, with this connecting straight line V between the slots being offset with respect to the parallel diameter D to such an extent that it lies approximately at the height of the ends of the narrow sides of the H-shaped pinch 21. The spring stress is preferably selected in such a way that the support strip 36 has a length of approximately 120 to 160% of the length of the connecting straight lines V between the slots 37.

Figure 8:
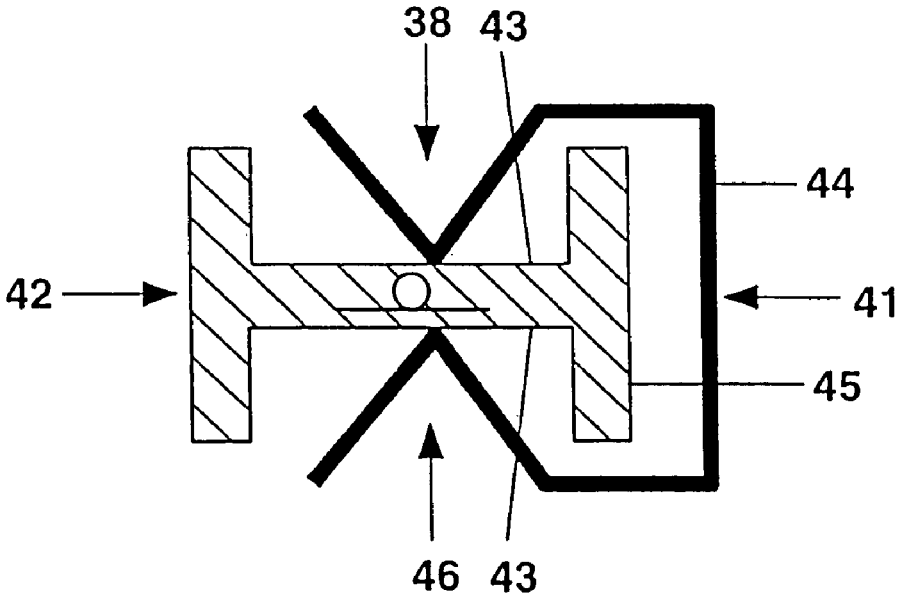

A further embodiment uses a perforated support strip 41 for securing to the discharge vessel 42, so that the bends in the support strip can be better matched to the shape of the H-shaped pinch 21. FIG. 8 shows a support strip 41 which, in a similar manner to in FIG. 3, is clamped securely to two wide sides 43 of the pinch, with a central section 44 surrounding a narrow side 45. Unlike in FIG. 3, however, suitable perforation of the support strip allows the central section 44 of the support strip to run parallel to the narrow side 45 and then to be bent off at right angles toward the wide sides. There, contact with the wide sides is effected in each case by means of an end section 46 which is V-shaped in form. In this way, the space taken up by the support strip is considerably reduced. This embodiment is particularly suitable for getters with a high working temperature and for lamps with a short distance between the outer bulb and the discharge vessel.

Figure 9:
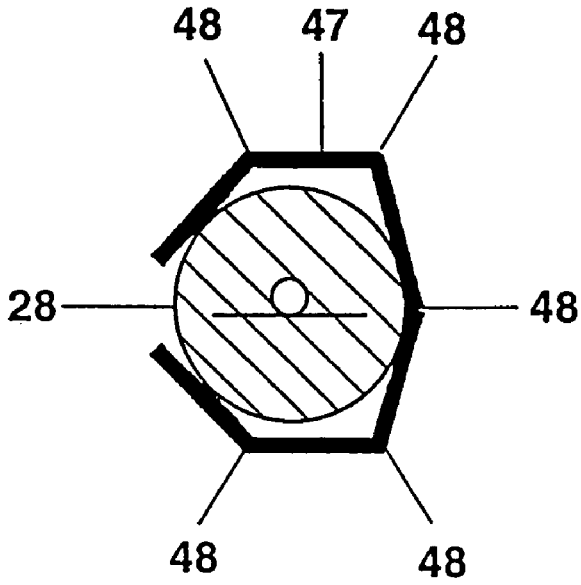

FIG. 9 shows an exemplary embodiment of a perforated support strip 47 which is secured to a fused seal 28. Compared to FIG. 4, the perforation allows a shorter support strip 47 to be used. The support strip is wrapped around the fused seal, which is cylindrical in cross section, over approximately 70 to 90% of its circumference, with five lines of perforations allowing sharp ends 48 to be made in the support strip. This makes the holding more reliable and more tightly fitting. There is no need for an extension as a fitting aid, as in FIG. 4.

Figure 10:
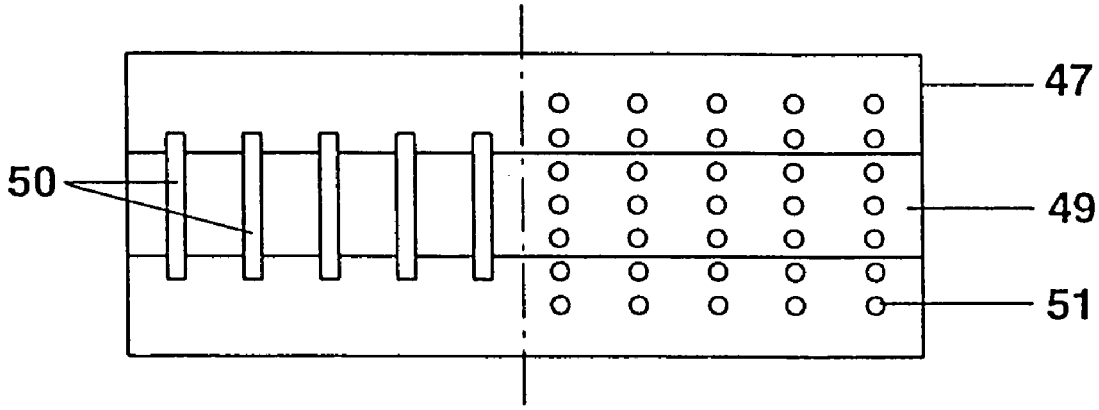
FIG. 10 shows a plan view of an exemplary embodiment of a perforated support strip.

FIG. 10 diagrammatically depicts a perforated support strip 47. In the unbent state, it is a metal sheet which has been cut at right angles and to which a getter material 49 has been applied, for example as a centrally running ribbon. In the exemplary embodiment shown (left-hand half), by way of example, five slots 50 have been punched into the support strip as perforation lines. Of course, the perforation may also be configured differently, for example may be formed by rows of stamped holes 51 along a line, as shown in the right-hand half of FIG. 10. The number of lines of perforations depends on the number of desired bends.

The stamped holes have the advantage that they can be formed over a greater proportion of the width of the metal sheet than the slots. On the other hand, the slots, the length of which is greater than the width of the getter-containing ribbon 49, have the advantage that it is impossible for any getter material, for example zirconium oxide, to flake off or crumble away when the metal sheet is being bent.

Of course, this technique can also be used for discharge vessels which are closed on one side, in particular pinched. This may be accommodated in an outer bulb which is closed on one side. Accordingly, the technique can also be used for a discharge vessel which is closed on two sides in an outer bulb closed on one side.

What is claimed is:

1. An electric lamp comprising:

an outer bulb and with an inner vessel, being a discharge vessel, arranged therein, a getter material being held on a support body inside the outer bulb, wherein the support body is a support strip to which the getter material is applied, wherein the support strip consists of a resilient material; and the support strip is curved in such a way that the support strip is mechanically held in the outer bulb;

exclusively by spring force.

2. The lamp as claimed in claim 1, wherein the support strip is bent in such a way that it has at least three bearing points on the inner surface of the outer bulb.

3. The lamp as claimed in claim 1, wherein the outer bulb is provided with a bulge which assists with secure holding of the support strip.

4. The lamp as claimed in claim 1, wherein the support strip is held on an inner surface of the outer bulb exclusively by spring force.

5. The lamp as claimed in claim 1, wherein the support strip is held on an outer surface of the inner vessel exclusively by spring force.

6. An electric lamp comprising: an outer bulb and with an inner vessel being a discharge vessel, arranged therein, a getter material being held on a support body inside the outer bulb, wherein the support body is a support strip to which the getter material is applied, the support strip being curved in such a way that it is automatically held in the outer bulb, wherein the support strip consists of elastic, and resilient spring steel, and wherein the support strip is clamped inside notches in the inner surface of the outer bulb.

7. An electric lamp comprising:

an outer bulb and with an inner vessel, being a discharge vessel, arranged therein, a getter material being held on a support body inside the outer bulb, wherein the support body is a support strip to which the getter material is applied, wherein the support strip consists of a resilient material; and the support strip is curved in such a way that the support strip is mechanically held in the outer bulb;

exclusively by spring force, and wherein the support strip is perforated and is secured to the discharge vessel in a clamping fashion by bending at the perforated locations.

8. An electric lamp comprising: an outer bulb and with an inner vessel, being a discharge vessel, arranged therein, a getter material being held on a support body inside the outer bulb, wherein the support body is a support strip to which the getter material is applied, the support strip being curved in such a way that it is automatically held in the outer bulb without the need for any auxiliary means, and wherein the inner vessel is closed off at two opposite ends, with the outer bulb being secured directly to the inner vessel.

* * * * *